US005298097A

United States Patent [19]

Zanferrari

[11] Patent Number: 5,298,097

[45] Date of Patent: Mar. 29, 1994

[54] APPARATUS AND METHOD FOR THERMALLY BONDING A TEXTILE WEB

[75] Inventor: Roberto Zanferrari, Bergamo, Italy

[73] Assignee: Neuberger S.p.A., Trezzano Rosa, Italy

[21] Appl. No.: 861,295

[22] Filed: Mar. 31, 1992

[51] Int. Cl.[5] ..... B32B 31/20

[52] U.S. Cl. ..... 156/62.2; 156/62.4; 156/62.6; 156/62.8; 156/180; 156/181; 156/244.24; 156/244.27; 156/276; 156/433; 156/437; 156/437; 156/441; 156/500; 156/501; 264/109; 264/113; 264/123

[58] Field of Search ..... 156/62.2, 62.4, 62.6, 156/62.8, 180, 181, 244.24, 244.27, 276, 433, 437, 441, 500, 501, 494; 264/109, 113, 123

[56] References Cited

U.S. PATENT DOCUMENTS

| | | | |
|---|---|---|---|
| 2,647,851 | 8/1953 | Schwartz | 156/62.8 |
| 2,825,117 | 3/1958 | Evans et al. | 26/69 R |
| 3,314,840 | 4/1967 | Lloyd et al. | 156/167 |
| 3,673,021 | 6/1972 | Joa | 156/62.8 |
| 3,705,068 | 12/1972 | Dobo et al. | 156/441 |
| 3,861,971 | 1/1975 | Stapleford et al. | 156/62.2 |
| 4,070,218 | 1/1978 | Weber | 156/167 |
| 4,168,195 | 9/1979 | Anderson et al. | 156/181 |
| 4,217,387 | 8/1980 | Viezee et al. | 156/167 |
| 4,668,566 | 5/1987 | Braun | 156/220 |
| 4,749,423 | 1/1988 | Vaalburg et al. | 156/181 |
| 4,976,820 | 12/1990 | Laapotti | 162/206 |

OTHER PUBLICATIONS

Gilmore, Thomas F., Spunbond Web Formation Processes: A Critical Review presented at INSIGHT 90 Conference, Toronto, Oct., 1990.

*Primary Examiner*—Caleb Weston

*Attorney, Agent, or Firm*—Bell, Seltzer, Park & Gibson

[57] ABSTRACT

An apparatus and method provides for thermally bonding a textile web while supporting the web continuously from the lay down point until the web is thermally bonded. The apparatus includes a heated transfer roll adjacent an endless moving belt. The transfer roll is located outside the belt loop on the opposite side of the belt from a guide roll. The belt passes around a first portion of the transfer roll with the web sandwiched between the belt and transfer roll. The heated transfer roll heats the web and the web is transferred to the transfer roll. The web is then directed through a nip formed by a calender roll positioned adjacent a second portion of the transfer roll for thermally bonding the web.

33 Claims, 1 Drawing Sheet

APPARATUS AND METHOD FOR THERMALLY BONDING A TEXTILE WEB

FIELD OF THE INVENTION

The present invention relates to an apparatus and method for thermally bonding a web of textile strands, and more particularly to an apparatus and method in which a web of textile strands is thermally bonded by passing through a heated calender nip.

BACKGROUND OF THE INVENTION

Various types of nonwoven fabrics are produced by thermally bonding textile strands made from thermoplastic resins. Thermally bonded nonwoven fabrics of this type are used, for example, in disposable diapers, catamenial products, wipes, surgical drapes, clothing, carpets, wall coverings, house wrap, upholstery and packaging, to name but a few applications.

Many of the above-noted types of nonwoven fabrics may be produced by the well known spunbonding process in which a thermoplastic polymer is extruded through a spinneret to form a multiplicity of continuous filaments, and the filaments of molten polymer are solidified and then drawn or attenuated, typically by a high velocity fluid, and then randomly deposited on a collection surface, such as a moving belt, to form a web. The filaments are then bonded to give the web coherency and strength. The bonding may be achieved by passing heated air, steam or other gas through the web, or by direct application of heat and pressure, such as through the use of heated calender rolls.

U.S. Pat. Nos. 4,070,218 and 4,668,566 illustrate a spunbonding process wherein calender rolls are used to thermally bond a spunbonded web. As shown, after the web is formed on the endless forming belt, it is removed from the belt and directed into the nip of a heated calender. The web passes unsupported from the forming belt to the calender, and is thus subjected to tension in this unsupported span. U.S. Pat. No. 4,668,566 shows the use of compaction rolls on the forming belt for slightly compacting the filaments to improve the integrity of the unbonded web prior to drawing the web in an unsupported condition. However, because of the tension which is applied to the web in the unsupported span, there remains the possibility for stretching, necking-down, or even breakage of the web in this area.

With the foregoing in mind, it is an object of the present invention to overcome the limitations of the prior apparatus and methods for thermally bonding a textile web with calender rolls.

A further object of the invention is to provide a method and apparatus that allows for operation at a high throughput while reducing the likelihood of necking down or breaking the web and associated yield losses.

SUMMARY OF THE INVENTION

The above and other objects of the present invention have been achieved by an apparatus and method in which the web is continuously supported from the point where the filaments are laid down until after the web has been bonded. Thus, the web does not pass through an unsupported span and is not subjected to tension prior to bonding.

The apparatus in accordance with the present invention comprises an endless moving belt for receiving a web of thermally bondable textile strands. A transfer roll having a heated peripheral surface is positioned so that a first portion of the transfer roll surface is adjacent the belt for engaging the web of textile strands and for transferring the web from the belt to the transfer roll. A calender roll is positioned adjacent a second portion of the transfer roll. The calender roll and transfer roll form a heated calender nip to thermally bond the textile web as it is directed through the nip. The thermally bonded web is directed along the calender roll surface upon leaving the nip.

In a more specific embodiment, the web of textile strands is formed directly upon the belt. The web of textile strands may, for example, be formed by extruding a plurality of continuous filaments of thermoplastic polymer directly onto the belt.

The present invention is particularly applicable to the production of a spunbonded web wherein continuous filaments are extruded from a spinning beam and the filaments are directed into an attenuator which uses high velocity currents of air to pneumatically attenuate and draw the filaments. The thus formed filaments are deposited onto the belt to form a continuous filament web.

In another specific embodiment, the belt upon which the web is formed is a foraminous belt and the apparatus includes a vacuum box that is positioned on the side of the foraminous belt opposite the textile web. The vacuum box cooperates with the belt for holding and immobilizing the web as it is carried by the belt and may extend over a portion of the transfer roll so that the web is kept immobilized until after the web has been transferred to the transfer roll.

The present invention also provides a process for thermally bonding a textile web wherein thermally bondable textile strands are deposited onto a moving endless belt to form a thermally bondable textile web. The belt with the web thereon is directed over a transfer roll having a heated peripheral surface for heating the web and causing the web to be transferred to the transfer roll. The process includes a step of passing the web into a nip formed by the transfer roll and a calender roll and thermally bonding the web.

In another specific embodiment, the textile strands are spunbonded filaments and the process includes the steps of extruding a plurality of continuous filaments of thermoplastic polymer, and drawing and attenuating the filaments before depositing them on the belt. The step of drawing and attenuating the filaments may involve directing the filaments into and through a confined passageway through which an air stream is flowing so as to pneumatically draw and attenuate the filaments.

In yet another specific embodiment, the belt is foraminous and the process includes the step of applying vacuum to the web through the foraminous belt for holding and immobilizing the web. This step can include applying vacuum over a portion of the transfer roll.

BRIEF DESCRIPTION OF THE DRAWINGS

Some of the features and advantages of the invention have been stated, others will become apparent from the detailed description which follows and from the accompanying drawings, in which.

DESCRIPTION OF THE PREFERRED EMBODIMENT

Figures 1, 2:
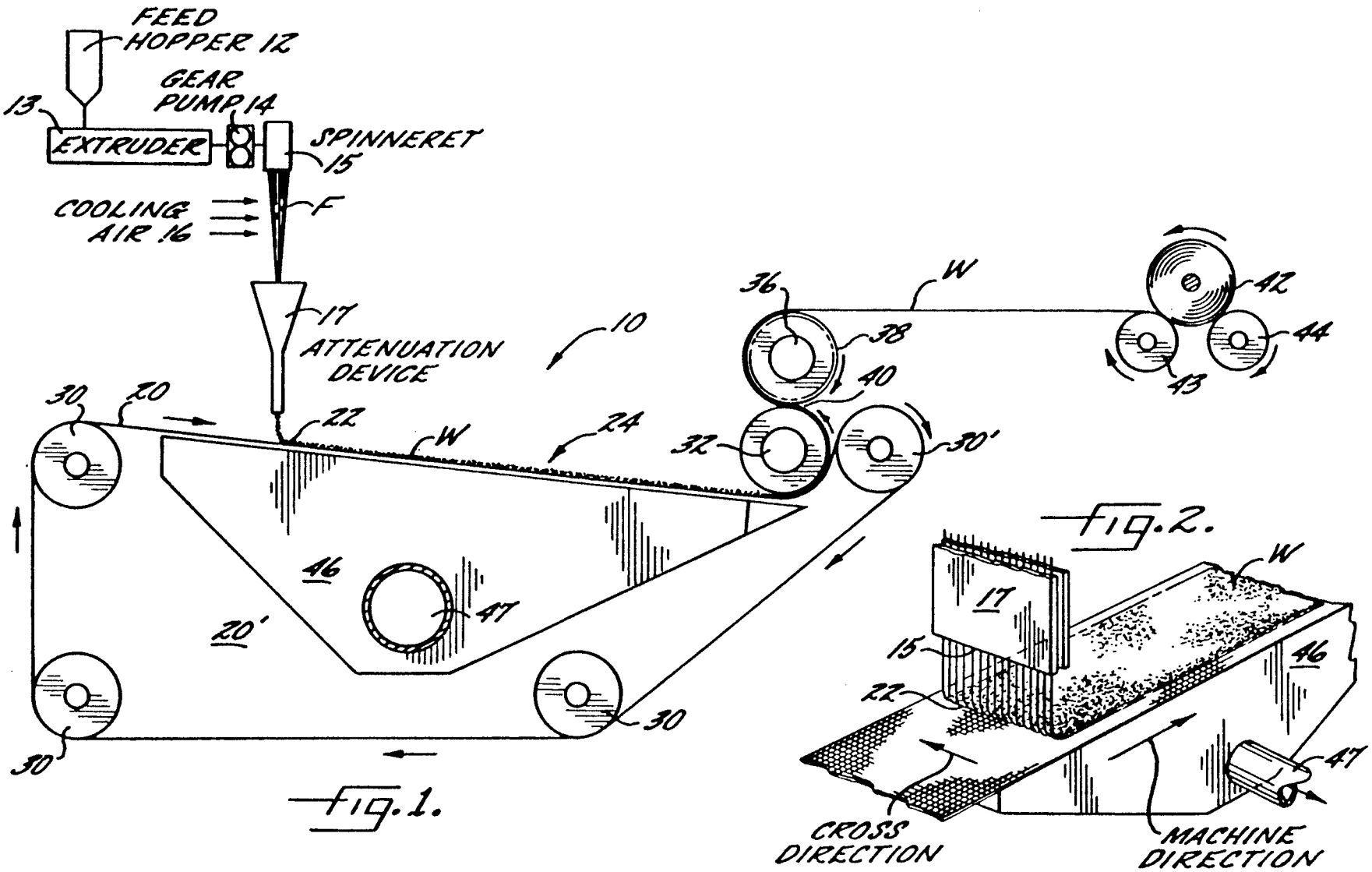
FIG. 1 schematically illustrates a preferred apparatus for forming and thermally bonding a web of textile filaments in accordance with the invention.
FIG. 2 is a perspective view of a portion of the apparatus of FIG. 1.

The present invention will now be described more fully with reference to the accompanying drawings which illustrate a preferred embodiment of the apparatus and method for thermally bonding a textile web.

In FIG. 1, the reference number 10 generally indicates an apparatus for producing a spunbonded web of continuous filaments. The apparatus 10 comprises a melt spinning section for producing continuous filaments of a thermoplastic polymer, including a feed hopper 12 for receiving the polymer raw material in granular or pellet form and an extruder 13 for heating the polymer to a molten plastic state. The spunbonding process is applicable to a large variety of polymer resins, copolymers, and mixtures thereof, and the skilled artisan will recognize that the present invention is of broad scope with respect to the specific resins that may be used.

The extruder 13 is provided with a gear pump 14 which directs the molten polymer at a controlled, metered rate to a generally linear die head or spinneret 15 where the molten polymer is extruded as streams from fine die orifices, which typically are from about 0.2 mm to about 0.9 mm in diameter. Continuous filaments F are extruded from the spinneret 15 and are quenched by a supply of cooling air 16. The filaments are directed to an attenuation device 17 which accelerates, draws and attenuates the filaments. The filaments are discharged from the bottom of the attenuation device and are deposited randomly on an endless forming belt 20.

Those skilled in this art are aware that the spunbonding machines and processes which are known in the art use various types of attenuation devices. The present invention is broadly applicable to the various known types of attenuation devices used in spunbonding machines and processes. For example, in the Lurgi spunbonding process, multiple round or tube-shaped devices pneumatically attenuate the filaments. A spinneret extrudes a molten polymer as continuous filaments. The filaments are attenuated as they exit the spinneret and are quenched, or solidified, by a flow of air. The filaments then enter the round attenuator gun where they are entrained with large quantities of high pressure air which provide the attenuation force for the filaments. As the filaments and air exit the gun, they move with an expanding supply of air to form a cone or a fan of separated filaments, which are deposited on a forming wire.

Another attenuating device is known as the slot draw attenuator. In the slot draw attenuator the multiple tube attenuators of the Lurgi process are replaced with a single slot-shaped attenuator which covers the full width of the machine. A supply of air is admitted into the slot attenuator below the spinneret face with or without a separate quench step. The air proceeds down the attenuator channel, which narrows in width in the direction away from the spinneret, creating a venturi effect, causing acceleration of the air and attenuation of the filaments. The attenuation air, depending on the type of slot draw process used, can be directed into the attenuation slot by a pressurized air supply above the slot, or by a vacuum located below the forming wire.

Slot drawing has various advantages over the Lurgi process. The slot attenuator is self-threading in that the filaments fall out of the spin block directly into the slot attenuator. The high pressure air used by Lurgi devices is not always required, thereby reducing noise and utility costs.

As shown in FIG. 1, the attenuation device 17 is generally of the slot draw type. The attenuation air may be directed into the attenuation device 17 by an air supply above the slot, by a vacuum located below the forming belt, or by the use of eductors integrally formed in the slot. The air proceeds down the attenuation device 17, which narrows in width in the direction away from the spinneret 14, creating a venturi effect and causing filament attenuation. The filaments exit the attenuation device 17 and are randomly deposited on endless moving belt 20 to form a web W.

The belt 20 is a foraminous belt so that the air discharged from the attenuator 17 can pass through the belt and so that vacuum can be applied to the web W through the belt, in a manner described below. The endless moving belt 20 forms a loop 20' that has a generally horizontally extending run 24 for supporting web W and for transporting the web from the initial laydown point 22 downstream to a second location. The direction of longitudinal movement of the belt is referred to herein as the machine direction. The belt 20 also has a cross direction (FIG. 2) which is perpendicular to the direction of travel of the web and serves as a reference direction for the web and the apparatus.

Guide rolls 30 located inside the loop 20' extend in substantially parallel relationship in the cross direction of the belt 20 for supporting the belt 20. The guide rolls and driven belt will be recognized by the skilled artisan as conventional equipment for receiving textile filaments and for forming textile webs.

A heated transfer roll 32 is located outside the loop 20' adjacent to and extending in the cross direction of the belt. The transfer roll 32 is positioned so that the belt 20 is deflected and Wraps partially around the roll, sandwiching the web W between the belt 20 and the transfer web. As the belt 20 separates from the transfer roll 32, the web remains on the surface of the transfer roll. The web W is thus transferred from the belt 20 to the roll 32 While being held and restrained by the belt and roll 32. As transfer roll 32 continues to rotate, the web W is advanced into and through a nip 40 formed between the transfer roll 32 and a calender roll 36.

The transfer roll 32 may be heated in any suitable manner, including by steam, oil, or by electrical resistance heaters. Oil heating is common and allows accurate temperature control. With oil heating, the heated roll is hollow and contains suitable inlet and outlet rotating seals and inner distribution channels (not shown) to ensure high and uniform heat transfer. Generally speaking, the transfer roll should be heated to a temperature below the melting point of the polymers forming the web, but sufficient to preheat and soften the web to provide a number of bonding sites sufficient to achieve the desired degree of bonding when pressure is applied to the web as it passes through nip 40.

In a preferred embodiment, the transfer roll has a smooth surface 34. The smooth surface promotes contact of a maximum surface area of the web with the transfer roll for even heating of the web. The transfer roll 32 is adjacent to and substantially parallel to one of the guide rolls 30' so that the belt 20 is wraps around a portion or sector of the heated surface of the transfer roll. This arrangement sandwiches the web between the belt and a portion of the transfer roll at 25. Thus sandwiching the web promotes contact of the web W with the transfer roll surface 34 for heating of the web prior to thermal bonding. Also, the temperature difference between the belt and the transfer roll facilitates transfer of the web to the transfer roll 32.

The calender roll 36 has a patterned surface 38 for point bonding the web W. Point bonding consists of cohering the filaments in small, discrete, and closely spaced areas of the fabric. Calender roll 36 and heated transfer roll 32 together form a heated calender nip 40 for thermally bonding the textile web W.

Although preferred is a heated transfer roll with a smooth surface and a calender roll with a patterned surface, the calender roll may be heated and the transfer roll may be patterned. Heating both rolls and having both rolls with patterns formed on the surface, called duplex bonding, allows the heat required to form the point bonds to penetrate from both sides of the web. In duplex bonding, part of the pattern is cut onto each roll and both rolls are heated to the bonding temperature. For example, opposing helical lands on the rolls generate a pattern of lozenge-shaped point bonds. Since the bonding heat has only half as far to penetrate into the web, the roll temperatures may be lower and the residence time in the nip zone may be shorter.

After textile web W passes through nip 40, the now thermally bonded web is directed along the calender roll surface 38 on leaving the nip 40 to a windup roll 42. As illustrated, the windup roll 42 is located downstream from the calender roll so that the web W follows the calender roll 36 for about one half its circumferential extent. Windup roll 42 includes associated guide rolls 43 and 44, which receive the thermally bonded web W from the calender roll 36 for winding. Windup roll 42 is conventional. As can be seen, tension from the windup roll 42 is not applied to the web 15'' until after the web has been thermally bonded and has left the nip 40.

Also shown in FIG. 1 is a vacuum box 46 inside the loop 20' that applies a vacuum through the belt 20 for holding and immobilizing the web 15' as it is carried by the belt 20. The vacuum box is a conventional sheet metal enclosure having a vacuum source connected thereto through conduit 47.

In the embodiment shown, the vacuum box 46 extends from just prior to the laydown point 22 to the region opposite the transfer roll 32 so that the web 15' will be immobilized by vacuum after it is laid down on the belt 20 until it is transferred to the transfer roll 32. In this manner, a more uniform web is produced because web disturbance is less likely. Also, the vacuum box 46 may be used to facilitate attenuation of the filaments, as was explained above, by drawing air through a slot draw attenuator. The skilled artisan will recognize that various charging techniques are also available to control web laydown, rather than using vacuum techniques.

FIG. 2 shows the vacuum box 46 of FIG. 1 underlying the foraminous surface of the endless moving belt 20 and shows how spunbonded thermoplastic filaments from the exit of attenuator 17 are laid down on the belt to form the web W. The attenuator 17 is shown to be a slot draw attenuator, although as explained above, other types of attenuators are contemplated for use in connection with the practice of this invention.

The foregoing description is intended to be considered illustrative rather than restrictive of the invention. The skilled artisan will recognize that there is a wide variety of techniques for producing nonwoven webs that can be thermally bonded in accordance with the present invention. For example, the present invention is also applicable to webs produced by meltblowing techniques. In meltblowing, thermoplastic resin is fed into an extruder where it is melted and heated to the appropriate temperature required for fiber formation. The extruder feeds the molten resin to a special melt-blowing die. The die arrangement is generally a plurality of linearly arranged small diameter capillaries. The resin emerges from the die orifices as molten threads into a high velocity stream of gas, usually air. The air attenuates the polymer into a blast of fine fibers which are collected on a moving screen placed in front of the blast. As the fibers land on the screen, they entangle to form a cohesive web. Meltblowing forms very small diameter fibers, typically about two micrometers in diameter and several inches in length, which entangle in the web sufficiently so that it is generally impossible to remove one complete fiber from the mass of fibers or to trace one fiber from beginning to end.

Meltblown webs exhibit a number of desirable properties. For example, the webs have good integrity due primarily to the fiber entanglement and surface attraction between the very small fibers. There are, in addition, advantages inherent in the meltblowing process itself. For example, the fibers are collected at a relatively short distance from the die, usually ranging from 12 to 6 inches, giving a positive control of the fiber blast and good edge control. Further, meltblowing can tolerate non-uniform polymer melts and mixtures of polymers which cannot be handled by other processes. A variety of polymers can be used in melt-blowing techniques, and in fact, melt blowing is said to be applicable to any fiber forming material that can give an acceptably low melt viscosity at suitable processing temperatures and which will solidify before landing on the collector screen or belt.

The present invention is also useful with various dry-formation mechanical methods for producing webs from thermoplastic strands, including carding and air-laying. In carding, clumps of staple fibers are separated and simultaneously formed into a coherent web. In air-laying, the fibers are captured on a screen from an air stream. Essentially any web formed from thermoplastic strands should be bondable by the apparatus and method of the present invention.

It should be understood, therefore, that the specific embodiment described hereinabove with reference to the drawings is an illustration of how the present invention may be practiced, and that the invention is not limited to this specific embodiment. Those modifications that come within the meaning and range of equivalence of the claims are to be included within the scope of the invention.

What is claimed is:

1. An apparatus for thermally bonding a textile web comprising:

a) an endless moving belt for receiving thereon a web of thermally bondable textile strands;

b) a transfer roll having a heated peripheral surface, a first portion of said surface being positioned adjacent said belt for engaging the web of textile strands and transferring the web from said belt to said transfer roll; and c) a calender roll having a peripheral surface positioned adjacent a second portion of said transfer roll surface to form a calender nip to thermally bond the web of textile strands as it passes through said nip, the thermally bonded web being directed along said calender roll surface upon leaving said nip.

2. The apparatus of claim 1 further comprising means cooperating with said belt at a location upstream from said transfer roll for forming a web of textile strands directly upon said belt.

3. The apparatus of claim 2 wherein said means for forming a web of textile strands comprises means for extruding a plurality of continuous filaments of thermoplastic polymer.

4. The apparatus of claim 1 wherein said belt is foraminous and said apparatus further comprises a vacuum box positioned on the side of said foraminous belt opposite the textile web, said vacuum box cooperating with said foraminous belt for holding and immobilizing the web as it is carried by said belt.

5. The apparatus of claim 4 wherein said vacuum box is also located opposite said transfer roll so that the web is immobilized by vacuum as it is transferred to said transfer roll.

6. The apparatus of claim 1 wherein said transfer roll surface is smooth and said calender roll surface is patterned.

7. The apparatus of claim 1 further comprising a windup roll for receiving the web from said calender roll.

8. An apparatus for thermally bonding a textile web comprising:

a) an endless moving belt for receiving thereon a web of thermally bondable textile strands;

b) a transfer roll having a heated peripheral surface, a first portion of said surface being positioned adjacent said belt for engaging the web of textile strands and transferring the web from said belt to said transfer roll;

c) a guide roll mounted adjacent said transfer roll and on the opposite side of said belt from said transfer roll, said guide roll being positioned so that said belt wraps around said first portion of said transfer roll with the web sandwiched between said belt and said transfer roll; and d) a calender roll having a peripheral surface positioned adjacent a second portion of said transfer roll surface to form a calender nip to thermally bond the web of textile strands as it passes through said nip, the thermally bonded web being directed along said calender roll surface upon leaving said nip.

9. An apparatus for thermally bonding a textile web comprising:

a) an endless moving belt forming a loop having a generally horizontally extending run for receiving at a first location and supporting thereon a web of thermally bondable textile strands for transport to a second location, said belt having a cross direction and a machine direction in which the web and said belt travel;

b) a plurality of guide rolls engaging said belt inside said loop and extending in the cross direction of said belt for supporting said belt for movement about said loop in said machine direction;

c) a heated transfer roll located outside said loop and adjacent to and extending in the cross direction of said belt at said second location thereof, said transfer roll being adjacent and substantially parallel to one of said guide rolls so that said belt is directed around a predetermined first portion of said heated surface of said transfer roll for promoting contact of the web with said transfer roll surface for heating of the web and transfer of the web to said transfer roll;

d) a calender roll having a peripheral surface positioned adjacent a second portion of said transfer roll for contact with the textile web to form a calender nip to thermally bond the textile web as it passes through said nip.

10. The apparatus of claim 9 further comprising means cooperating with said belt at a location upstream from said transfer roll for forming a web of textile strands directly upon said belt.

11. The apparatus of claim 10 wherein said means for forming a web of textile strands comprises means for extruding a plurality of continuous filaments of thermoplastic polymer.

12. The apparatus of claim 9 wherein said belt is foraminous and said apparatus further comprises a vacuum box inside said loop that cooperates with said belt for holding and immobilizing the web as it is carried by said belt.

13. The apparatus of claim 12 wherein said vacuum box inside said loop is also located opposite said transfer roll so that the web is immobilized by vacuum as it is transferred to said transfer roll.

14. The apparatus of claim 9 wherein said transfer roll surface is smooth and said calender roll surface is patterned.

15. The apparatus of claim 9 further comprising a windup roll for receiving the web from said calender roll, said windup roll being positioned so that the thermally bonded web is directed along said calender roll upon leaving said nip.

16. An apparatus for thermally bonding a web of spunbonded thermoplastic filaments comprising:

a) a spinning beam for extruding a plurality of continuous filaments of thermoplastic polymer;

b) an attenuator positioned for receiving the extruded filaments and for drawing and attenuating the filaments;

c) an endless moving belt forming a loop having a generally horizontally extending run for supporting a web of filaments thereon; said belt being positioned for receiving the filaments from said attenuator at a first location on the belt to form a web of filaments and for transporting the web of filaments on the belt to a second location;

d) a plurality of guide rolls engaging said belt inside said loop for supporting said belt for movement about said loop;

e) a transfer roll located outside said loop and positioned adjacent to and extending across said belt at said second location thereof, said transfer roll having a heated peripheral surface and being positioned so that said belt wraps around a predetermined first portion of the heated surface of said roll with the web sandwiched therebetween for promoting contact of the web with said transfer roll surface for heating of the web and transfer of the web to said transfer roll;

f) a calender roll having a peripheral surface positioned opposite a second portion of said transfer roll to form a calender nip to thermally bond the textile web as it passes through said nip.

17. The apparatus of claim 16 including means cooperating with the thermally bonded web downstream from said nip for directing the web along the surface of said calender roll surface upon leaving said nip.

18. The apparatus of claim 16 wherein said attenuator includes means for pneumatically drawing and attenuating the filaments.

19. The apparatus of claim 16 wherein said belt is foraminous and said apparatus further comprises a vacuum box inside said loop, said vacuum box cooperating with said foraminous belt for holding and immobilizing the web as it is carried by said belt.

20. The apparatus of claim 19 wherein said vacuum box inside said loop is also located opposite said transfer roll so that the web is immobilized by vacuum as it is transferred to said transfer roll.

21. The apparatus of claim 16 wherein said transfer roll surface is smooth and said calender roll surface is patterned.

22. A process for thermally bonding a textile web comprising the steps of:

a) depositing thermally bondable textile strands onto a moving endless belt to form a thermally bondable textile web;

b) directing the belt with the web thereon over a transfer roll having a heated peripheral surface for preheating the web and causing the web to be transferred to the transfer roll;

c) passing the web into a nip formed by the transfer roll and a calender roll and thermally bonding the web.

23. The process of claim 22 wherein the process includes the additional steps of extruding a plurality of continuous filaments of thermoplastic polymer, and drawing and attenuating the filaments before depositing the filaments on said belt.

24. The process of claim 22 wherein the belt is foraminous and said process includes the additional step of applying vacuum to the web through the foraminous belt to hold and immobilize the web as it is carried by the belt.

25. The process of claim 24 wherein said step of applying vacuum to the web through the foraminous belt includes applying vacuum to the web while the web is sandwiched between said belt and said transfer roll so that the web is immobilized by vacuum as it is transferred to said transfer roll.

26. The process of claim 22 further comprising the step of directing the thermally bonded web along the surface of the calender roll when the web exits the nip.

27. The process of claim 26 further comprising the step of winding the thermally bonded web on a windup roll after the web is directed along the surface of the calender roll.

28. A process for thermally bonding a web of spunbonded thermoplastic filaments comprising:

(a) extruding a plurality of continuous filaments of thermoplastic polymer;

(b) drawing and attenuating the filaments and depositing the drawn and attenuated filaments at a first location on an endless moving belt to form a web;

(c) directing the belt and the web thereon around a portion of the peripheral surface of a heated transfer roll so that the web is sandwiched between the transfer roll surface and the belt and is preheated by the transfer roll;

(d) separating the belt from transfer roll while leaving the web on the surface of the transfer roll; and (e) directing the web through a nip formed between the transfer roll and a calender roll and thermally bonding the web.

29. The process of claim 28 wherein said step of drawing and attenuating the filaments comprises directing the filaments into and through a confined passageway through which an air stream is flowing so as to pneumatically draw and attenuate the filaments.

30. The process of claim 28 wherein the belt is foraminous and said process includes the additional step of applying vacuum to the web through the foraminous belt for holding and immobilizing the web.

31. The process of claim 30 wherein the step of applying vacuum to the web through the foraminous belt includes applying vacuum over a portion of the transfer roll.

32. The process of claim 28 further comprising the step of directing the thermally bonded web along the surface of the calender roll when the web exits the nip.

33. The process of claim 32 further comprising the step of winding the thermally bonded web on a windup roll after the web is directed along the surface of the calender roll.

* * * * *